United States Patent [19]

Arciniega

[11] Patent Number: 5,035,423

[45] Date of Patent: Jul. 30, 1991

[54] BASKETBALL TRAINING FACILITY

[76] Inventor: Richard J. Arciniega, 10637 Braes Bend, Houston, Tex. 77071

[21] Appl. No.: 533,487

[22] Filed: Jun. 5, 1990

[51] Int. Cl.[5] ..... A63B 63/08

[52] U.S. Cl. ..... 273/150 A; 273/406

[58] Field of Search ..... 273/1.5 R, 1.5 A, 368, 273/406, 397, 396, 398-402

[56] References Cited

U.S. PATENT DOCUMENTS

| | | | |
|---|---|---|---|
| 1,574,201 | 2/1926 | Lynch | 273/1.5 R X |
| 1,924,757 | 8/1933 | Shisoff | 273/397 |
| 4,202,543 | 5/1980 | Collins | 273/1.5 R X |
| 4,239,214 | 12/1980 | Brenner | 273/1.5 R |
| 4,522,394 | 6/1985 | Broussard | 273/1.5 R |
| 4,546,973 | 10/1985 | Mouser | 273/1.5 R |
| 4,699,386 | 10/1987 | Carzino | 273/397 X |
| 4,700,952 | 10/1987 | Patsy | 273/406 X |
| 4,738,448 | 4/1988 | Liester | 273/1.5 R |
| 4,805,917 | 2/1989 | Cochran et al. | 273/397 |
| 4,951,944 | 8/1990 | Morgan | 273/1.5 R |

*Primary Examiner*—Paul E. Shapiro

*Attorney, Agent, or Firm*—Pravel, Gambrell, Hewitt, Kimball & Krieger

[57] ABSTRACT

A basketball training facility comprised of an enclosed area, a ball return device suspended within the enclosed area, a selectively rotating basketball goal, a track mounted motor driven carriage and controls for indexing the basketball goal toward and away from a player, a motor driven telescopic pole and controls for vertically indexing the basketball goal and a loud speaker system and a video projection system for providing audio and visual distractions within the facility. The facility thus permitting the player to simulate shooting a basketball from various angles and distances with respect to the goal without having to waste time retrieving basketballs following shots. Further, the audio and visual distractions acclimate the player to conditions likely encountered during a game.

39 Claims, 3 Drawing Sheets

BASKETBALL TRAINING FACILITY

FIELD OF THE INVENTION

The present invention is related to the field of basketball training devices, in particular to a training facility designed to improve a player's shooting ability and concentration.

DESCRIPTION OF THE PRIOR ART

One of the major skills required in the game of basketball is the ability to shoot the basketball through the goal from various positions on the court under a variety of conditions. The skill is generally improved by shooting repetitive practice shots from the various positions on the court. However, a player, unless being assisted by another party, must chase down and retrieve the ball following a shot and move to the desired position from which to make the next shot. The practice of retrieving the ball consumes time and often breaks the players concentration on the mechanics of shooting the ball.

The player must also be able to practice shooting from a variety of positions on the court. Under game conditions, the player must be able to shoot the ball from positions on the court which do not present a shot normal to the basketball goal backboard. Further, a player's normal shooting range may vary from player to player, i.e., a center or forward is more likely to play near or under the basketball goal and shoot from that position than from further away from the goal where a guard would normally play.

Lastly, a player must learn to concentrate on the mechanics of shooting until such mechanics become automatic. However, merely shooting the ball during practice does not simulate the game conditions in which a player will generally be guarded by an opposing player. Further, there is generally an absence of crowd noise and fans attempting to distract the player during a practice session.

A number of prior art devices have been directed to training a player to shoot the ball accurately. There are a number of ball return devices which are known in the prior art. U.S. Pat. No. 4,838,549 to Woodall discloses a basketball return device capable of returning the ball to the player. However, should the ball bounce outside of the netted enclosure disclosed in Woodall, the player must still retrieve the ball. Further, while Woodall discloses means for attaching the return device at an angle other than normal the basketball backboard, the return frame severely limits the flight of any shot. In addition, an errant shot may still bounce over the return device requiring the player to retrieve the ball. U.S. Pat. No. 4,786,371 to Postol also discloses a basketball return device which is affixed to the backboard. However, should an errant shot bounce out of the area covered by the net, the player would be required to retrieve the ball. Where the player is shooting from an angle other than normal to the basketball goal, the an errant shot is just as likely to miss the return net as to fall within the net and be returned to the player. Similarly, U.S. Pat. No. 4,869,502 to Wares also discloses a basketball return device which is affixed to the backboard. As with the Postol disclosure, it does not disclose a means for effectively returning errant shots and/or shots taken at an angle other than normal to the basketball goal.

There are also a number of devices which are designed to simulate shooting from various positions on a basketball court. Soviet Patent No. 1,105,205 discloses a backboard which is capable of rotating ±90 degrees about a vertical axis. Thus, it is capable of simulating shots taken at various angles with respect to the backboard. Further the Soviet patent discloses a gimballed backboard capable of rotating the backboard ±15 degrees about a central horizontal axis. However, the Soviet patent does not disclose any ball return device. U.S. Pat. No. 4,202,543 to Collins discloses a basketball training facility is which a basketball goal is rotated continuously about a vertical axis. While this simulates shooting from various positions on a basketball court, it does not give the player the opportunity to practice shooting from the same position and the ability to perfect the mechanics of shooting from that position.

None of the prior art devices disclose or suggest the ability to simulate shooting from various positions on a court and the use of a ball return device. Further, the ball return devices disclosed by their very nature limit the distance from which a player may shoot the ball. The return device extends a fixed distance form the goal. Thus, a player is unable to practice shooting near or under the basketball goal.

Thus, there exists a need for a basketball training facility which does not require the space of an entire basketball court, incorporates an automatic ball return device and allows the player to simulate shooting from various angles and distances on a basketball court. Lastly, it is desirable that such facility provide for means of audially and visually distracting the player during shooting practice forcing the player to concentrate on the mechanics of shooting despite the distractions.

SUMMARY OF THE PRESENT INVENTION

The present invention is directed to a basketball training facility which requires less room than a basketball half-court but will permit a player to simulate shooting goals from various positions on a basketball court. Further, the present invention is capable of retrieving all balls to a location convenient to the player irrespective of whether the shot is a successful or errant shot. Lastly, the present invention is capable of providing audial and visual distractions which forces a player to concentrate on the mechanics of shooting despite such distractions.

The training facility is composed of an enclosed area having a basketball goal mounted therein. Mounted in the enclosed area is a large ball return device fabricated from a net or other suitable materials. A basketball goal is mounted within the return device. The basketball return device cooperates with the enclosed area such that all shots are returned to the player, not merely successful shots. The basketball goal is capable of rotating ±90 degrees in response to a remote control setting by the player. Thus, the player may simulate shooting directly at the goal, from either side court or from any angle in between. The basketball goal itself is mounted on a platform which is capable of being moved toward or away from the player within the ball return device. The player may move the goal toward him to practice shots close to the basket or may move the goal further back within the ball return device to practice long-distance shots such as three point shots. In addition, the present invention has the ability to vertically position the between the standard 10 foot height down to a reduced height for younger players. The ball return device operates to return all balls to an area near the shooter. In addition, the present invention includes a loud speaker system and a video projection system capable of mounted within the facility to permit the player to selectively turn on a recording of simulated game noises or any other desirable audio track. Similarly, the player may selectively turn on a pre-recorded video displaying game scenes or any other video information which will be projected against the walls. The controls for the rotation of the basketball goal, the movement of the basketball goal toward or away from the player, height of the goal and control and input devices for the audio and video inputs are all located within the facility next to the ball return thus permitting the player to control all phases of operation of the facility.

BRIEF DESCRIPTION OF THE DRAWINGS

The objects, advantages and features of the present invention will become more apparent by reference to the drawings which are appended hereto and wherein like numerals include like parts and wherein an illustrative embodiment of the invention is shown, of which.

DETAILED DESCRIPTION OF THE PREFERRED EMBODIMENT

Figure 1:
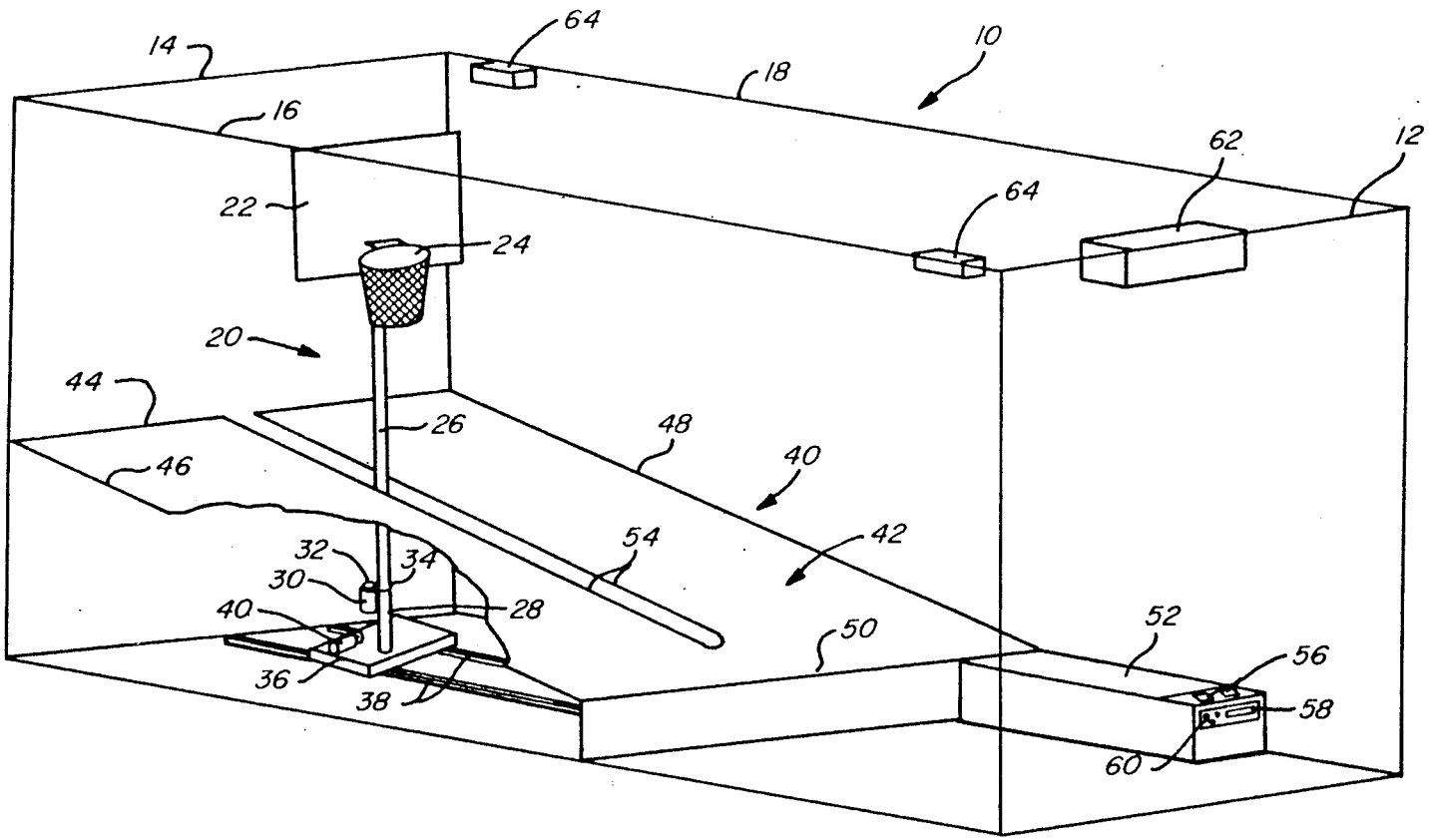
FIG. 1 is perspective view of the training facility including a partial sectional view.

FIG. 1 is a perspective view of the training facility 10. The training facility 10 enclosure is generally rectangular in shape and comprises a back wall 12, a front wall 14 and two opposed side walls 16 and 18. Mounted within the facility 10 is basketball goal assembly 20. The goal assembly 20 comprises a standard basketball backboard 22 and goal 24 mounted on a two part goal pole having an upper pole section 26 and a coaxial lower pole portion 28. The upper pole 26 is capable of rotating with respect to the lower pole 28 and may be rotated in response to any suitable mechanical means. In the preferred embodiment, the upper pole 26 is rotated about the lower pole 28 in response to an electric motor 30 mounted on lower pole 28. The motor 30 has a drive gear 32 which is adapted to mate with a drive gear 34 mounted on the periphery of the upper pole 26. It will be appreciated that other suitable means such as hydraulic drives, belt drives or other means may be used to rotate the upper pole 26 about the lower pole 28. In the present invention, the motor 30 also includes electrical limit switches (not shown) which may be used to limit the rotation of the upper pole 26 about the lower pole 28 to ±90 degrees. The lower pole 28 is itself mounted on a platform 36. Platform 36 is adapted to be indexed along parallel rails 38 by means of electric motor 40. The means by which the motor 40 indexes the platform 36 along rails 38 shall be explained in further detail below.

A ball return device 40 is mounted within the facility 10. The return surface 42 may be manufactured from a suitable material such as a net or other material such as high impact plastic which permits a basketball to roll on the material when in contact with it. The return surface 42 is suspended next to the walls or may be affixed to the walls of the facility 10 along front rail 44, sides rails 46 and 48 and a back platform 50. It will be appreciated that front rail 44 and side rail 46 will be mounted within the enclosure 10 substantially higher along walls 14 and 16 than rail 48 and platform 50. Thus all basketballs falling within the return device 40 will tend to roll on return surface 42 toward wall 18 and platform 50. Also attached to the return device 40 is a ball chute 52. As all basketballs falling within the return device 40 will tend to roll down and toward wall 18, the balls will then be deposited into chute 52 from which the player may readily and quickly extract the balls without having to manually retrieve them. Because the basketball goal assembly 20 is intended to move toward and away from the rear wall 12, provisions must be made within the ball return device 40 to permit the goal assembly 20 to move. Accordingly, the present invention includes two parallel rails 54 which are mounted on front wall 14 and project out from front wall 14 substantially parallel to rail 46. The spacing between the parallel rails 54 is sufficient to permit the upper pole 26 to pass therebetween. However, it is sufficiently narrow to prevent a basketball from falling between the rails and to prevent a basketball from arresting its movement down towards chute 52. Thus, the ball return device 40 permits the player to shoot from varying distances from the goal 24 while still being able to take advantage of the ball return device 40.

The controls 56 for the rotation of upper pole 26 and indexing of platform 36 are mounted at the end of the ball chute 52. Thus the player may readily vary the distance and the angle of the shot.

The present invention also includes the ability to simulate game conditions by means of providing audio and visual distractions. A video input device 58 such as a video cassette recorder or player is also mounted at the end of ball chute 52. Further, a separate audio device 60 is also mounted at the end of ball chute 52. The player may insert a video cassette tape which may include an audio track into the video input device. The video input is projected onto walls 14, 16 and 18 by means of a video projection unit 62 commonly known and used in the industry. Further, the video sound track may be reproduced through auxiliary speakers 64. Alternatively, a player may choose to rely only upon audio input and may insert a cassette tape into the audio device and reproduce audio input through speakers 64.

Thus, the present invention provides a means for simulating shots from various positions on the court, including varying distances from the basket and providing audio and visual distractions to force the player to concentrate on the mechanics of shooting.

Figure 2:
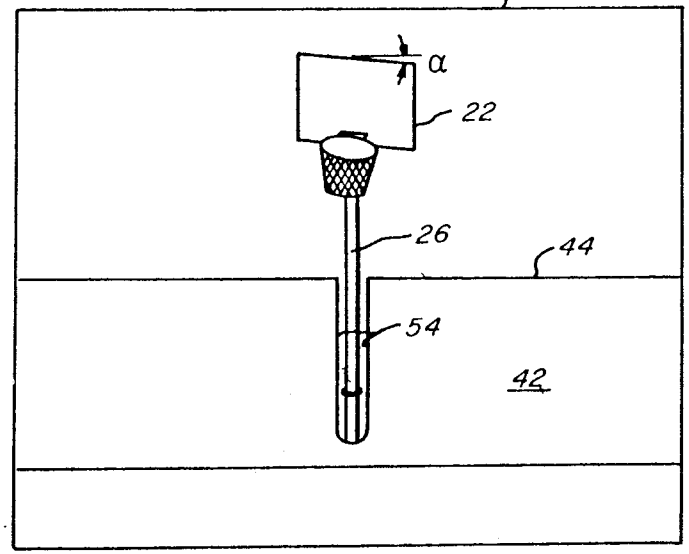
FIG. 2 is an elevational view of the basketball goal when rotated from a normal position.

FIG. 2 is a elevational view showing basketball goal having been rotated at an angle $\alpha$. By rotating the basketball goal, the player is thus able to simulate from shooting off center line of a basketball court.

Figure 3:
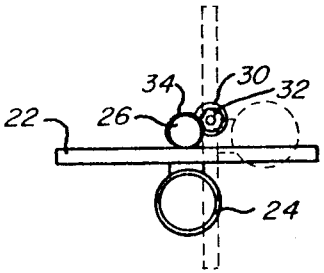
FIG. 3 is an elevational view illustrating the rotation of the basketball goal.

FIG. 3 is a top view showing the present invention's ability to rotate the basketball goal. The backboard 22 is shown as being positioned parallel to the back wall 12 (FIG. 1). The upper pole 26 and drive gear 34 are shown, as are the motor 30 and drive gear 32. The backboard 22 is shown in phantom as having been rotated 90° such that it is substantially parallel to side walls 16 and 18. The player may thus simulate shooting from the left side court when the backboard 22 is rotated in this position.

Figure 5:
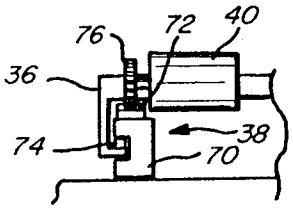
FIG. 5 is a partial sectional view of the drive mechanism.
Figure 4:
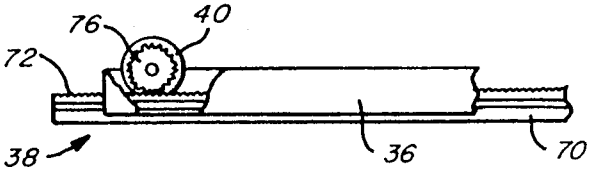
FIG. 4 is a partial sectional view of the drive mechanism.

FIGS. 4 and 5 are partial sectional views of the rail 38 and platform 36 upon which the goal assembly 20 is supported. The rail 38 is comprised of two sections, a support portion 70 and a drive rack 72. The drive rack 72 has linear gear teeth machined into its top face and is affixed to the support portion by means of countersunk machine bolts (not shown) or other suitable mechanical fashion. The support platform 36 includes an arm and slider block 74 which is adapted to fit underneath drive rack 72 and into support portion 70. Thus, the platform 36 is retained on the drive rails 38 and is not displaced as basketball shots strike the backboard 22. Motor 40 is mounted on platform 36 and includes a drive gear 76, drive gear 76 being adapted to mate with the gear teeth on drive rack 72. Thus, engagement of motor 40 will cause drive gear 76 to move along the drive rack 72 thereby moving platform 36 along the rails 38.

Figure 6:
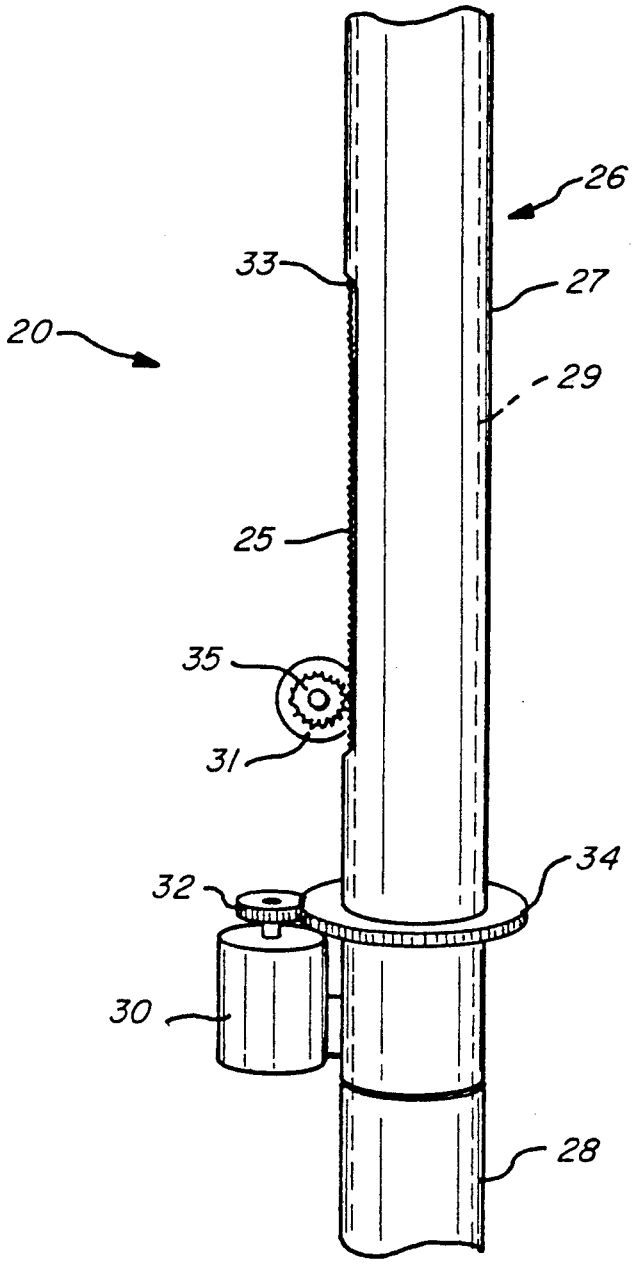
FIG. 6 is a partial sectional view of the vertical height adjustment means.

FIG. 6 is a partial sectional view illustrating the means for vertically positioning the goal assembly. The ability to vertically position the height of the goal assembly 20 is advantageous when training younger players. Younger players will generally shoot at a basket which is eight feet above the floor. As depicted in FIG. 6, the upper pole 26 comprises two telescoping members: an outer pole 27 and an inner pole 29. The inner pole 29 may be moved vertically relative to the outer pole 27 to raise or lower the height of the goal assembly 20. As shown, the outer pole 27 has a vertical slot 33 therethrough extending up from drive gear 34. The inner pole 29 has a gear drive rack 25 mounted vertically on inner pole 27. The inner pole 29 and drive rack 25 are mounted within outer pole 27 such that the drive rack 25 extends through outer pole 27 slot 33. An electric motor 31 having a drive gear 35 is adapted to be mounted on the outer pole 27 such that the drive gear 35 is in mating contact with drive rack 25. The activation of electric motor 31 will cause drive gear 35 to rotate, thereby indexing drive rack 25 and inner pole 29 to index vertically. The vertical drive mechanism may be pre-set to specific heights, i.e., 8 feet or 10 feet or may be permitted to vary through a range of heights. While the present invention utilizes a electromechanical means for vertically indexing the goal assembly 20, the use of other means, such as commercially available hydraulic or pneumatic indexing methods are also contemplated within the present invention.

The description given here is intended to illustrate the preferred embodiment of this invention. It is possible to make various changes to the details of the apparatus without departing from this invention. It is intended that all such variations be included within the following claims.

I claim:

1. A basketball training facility for use by a player in practicing shooting a basketball comprising:

(a) an enclosed area, the enclosed area having a floor, a front wall, two side walls and a back wall;

(b) a basketball backboard and goal, the backboard and goal being mounted on a vertical support member within the enclosed area;

(c) means for rotating the backboard and goal about the vertical support member;

(d) a ball return means mounted within the enclosed area; and (e) means for indexing the vertical support member toward and away from said player.

2. The apparatus of claim 1 wherein the means for rotating the backboard and goal about the vertical support member includes and electric motor drive.

3. The apparatus of claim 2 wherein the electric motor drive is remotely controlled by said player.

4. The apparatus of claim 1 wherein the means for indexing the vertical support means toward and away from said player comprises:

(a) the vertical support means being mounted on a platform;

(b) two substantially parallel rails mounted on the floor of the enclosure, the platform being adapted to be mounted on and be retained by the rails; and (c) means for indexing the platform along the rails.

5. The apparatus of claim 4, wherein the means for indexing the platform along the rails comprises:

(a) the rails having a linear gear rack mounted on the top of the rails;

(b) an electric motor mounted on the platform, the electric motor having a drive gear mounted thereon, the drive gear adapted to mate with the linear drive rack mounted on the rails; and (c) means for securing the platform in slidable contact with the rails.

6. The apparatus of claim 5, wherein the electric motor mounted on the platform is remotely controlled by said player.

7. The apparatus of claim wherein the ball return device comprises:

(a) a ball return surface, the surface being suspended above the floor of the enclosure in close proximity to the front and side walls of the enclosure, the surface being suspended to form a plane such that when said basketball placed on the surface, said basketball will tend to roll toward the back wall and a selected side wall;

(b) a ball return chute in close proximity to the ball return surface, the chute adapted for receiving and retaining said basketball as it leaves the ball return surface; and (c) means for permitting the linear indexing of the vertical support member through the return surface and permitting the free movement of said basketball.

8. The apparatus of claim 7, wherein the means for permitting the linear indexing of the vertical support member through the ball return surface includes two substantially parallel return surface support members, the members being mounted on the front wall of the enclosure and lying substantially in the plane of the ball return surface and adapted to be connected to the ball return surface, the spacing between the return support members adapted to permit the passage of the vertical support member therebetween without permitting said basketball to be lodged therebetween or fall through.

9. The apparatus of claim 7, wherein the ball return surface includes a net.

10. The apparatus of claim 7 wherein the ball return surface includes an elastomeric material.

11. The apparatus of claim 7, wherein the means for suspending the ball return surface in close proximity to the front wall and two side walls includes suspending the ball return surface on the walls.

12. A basketball training facility for use by a player in practicing shooting a basketball comprising:

(a) an enclosed area, the enclosed area having a floor, a front wall, two side walls and a back wall;

(b) a basketball backboard and goal, the backboard and goal being mounted on a vertical support member within the enclosed area;
(c) means for rotating the backboard and goal about the vertical support member;
(d) a ball return means mounted within the enclosed area;
(e) means for indexing the vertical support member toward and away from said player;
(f) means for creating visual distractions along the walls of the enclosure; and
(g) means for creating audial distractions within the enclosure.

13. The apparatus of claim 12 wherein the means for rotating the backboard and goal about the vertical support member includes and electric motor drive.

14. The apparatus of claim 13 wherein the electric motor drive is remotely controlled by said player.

15. The apparatus of claim 12 wherein the means for indexing the vertical support means toward and away from said player comprises:
(a) the vertical support means being mounted on a platform;
(b) two substantially parallel rails mounted on the floor of the enclosure, the platform being adapted to be mounted on and be retained by the rails; and
(c) means for indexing the platform along the rails.

16. The apparatus of claim 15, wherein the means for indexing the platform along the rails comprises:
(a) the rails having a linear gear rack mounted on the top of the rails;
(b) an electric motor mounted on the platform, the electric motor having a drive gear mounted thereon, the drive gear adapted to mate with the linear drive rack mounted on the rails; and
(c) means for securing the platform in slidable contact with the rails.

17. The apparatus of claim 16, wherein the electric motor mounted on the platform is remotely controlled by said player.

18. The apparatus of claim 12 wherein the ball return device comprises:
(a) a ball return surface, the surface being suspended above the floor of the facility in close proximity to the front and side walls of the enclosure, the surface being suspended to form a plane such that when said basketball placed on the surface, said basketball will tend to roll toward the back wall and a selected side wall;
(b) a ball return chute in close proximity to the ball return surface, the chute adapted for receiving and retaining said basketball as it leaves the ball return surface; and
(c) means for permitting the linear indexing of the vertical support member through the return surface and permitting the free movement of said basketball.

19. The apparatus of claim 18, wherein the means for permitting the linear indexing of the vertical support member through the ball return surface includes two substantially parallel return surface support members, the members being mounted on the front wall of the enclosure and lying substantially in the plane of the ball return surface and adapted to be connected to the ball return surface, the spacing between the return support members adapted to permit the passage of the vertical support member therebetween without permitting said basketball to be lodged therebetween or fall through.

20. The apparatus of claim 18, wherein the ball return surface includes a net.

21. The apparatus of claim 18 wherein the ball return surface includes an elastomeric material.

22. The apparatus of claim 18, wherein the means for suspending the ball return surface in close proximity to the front wall and two side walls includes suspending the ball return surface on the walls.

23. The apparatus of claim 12, wherein the means of creating a visual disturbance along the walls of the enclosure comprises:
(a) a pre-recorded video cassette having video information thereon;
(b) a video cassette recorder; and
(c) a video projection unit mounted on the back wall of the enclosure, the video projection unit being connected to the video cassette recorder, the projection unit thereby projecting the prerecorded video information on the walls of the enclosure.

24. The apparatus of claim 12, wherein the means of creating an audial disturbance comprises:
(a) a prerecorded audio cassette;
(b) an audio cassette player; and
(c) speakers mounted in the enclosure, the speakers being connected to the audio cassette player thereby reproducing the prerecorded sounds of the audio player.

25. A basketball training facility for use by a player in practicing shooting a basketball comprising:
(a) an enclosed area, the enclosed area having a floor, a front wall, two side walls and a back wall;
(b) a basketball backboard and goal, the backboard and goal being mounted on a vertical support member within the enclosed area;
(c) means for rotating the backboard and goal about the vertical support member;
(d) a ball return means mounted within the enclosed area;
(e) means for indexing the vertical support member toward and away from said player;
(f) means for vertically indexing the basketball goal to vary the height of the goal; and
(g) means for creating a visual disturbance along the walls of the facility; and means for creating an audial disturbance within the facility.

26. The apparatus of claim 25 wherein the means for rotating the backboard and goal about the vertical support member includes an electric motor drive.

27. The apparatus of claim 26 wherein the electric motor drive is remotely controlled by said player.

28. The apparatus of claim 25 wherein the means for indexing the vertical support means toward and away from said player comprises:
(a) the vertical support means being mounted on a platform;
(b) two substantially parallel rails mounted on the floor of the enclosure, the platform being adapted to be mounted on and be retained by the rails; and
(c) means for indexing the platform along the rails.

29. The apparatus of claim 28, wherein the means for indexing the platform along the rails comprises:
(a) the rails having a linear gear rack mounted on the top of the rails;
(b) an electric motor mounted on the platform, the electric motor having a drive gear mounted thereon, the drive gear adapted to mate with the linear drive rack mounted on the rails; and (c) means for securing the platform in slidable contact with the rails.

30. The apparatus of claim 29, wherein the electric motor mounted on the platform is remotely controlled by said player.

31. The apparatus of claim 25, wherein the means of vertically indexing the goal includes (a) a vertical support member comprising an inner and an outer vertical support members, the inner support member being positioned within the outer support member in a telescoping manner; and (b) means for vertically indexing the inner vertical support member relative to the outer support member.

32. The apparatus of claim 25, wherein the means for vertically indexing the inner support member relative to the outer support member includes an electric motor drive.

33. The apparatus of claim 25 wherein the ball return device comprises:

(a) a ball return surface, the surface being suspended above the floor of the facility in close proximity to the front and side walls of the enclosure, the surface being suspended to form a plane such that when said basketball placed on the surface, said basketball will tend to roll toward the back wall and a selected side wall;

(b) a ball return chute in close proximity to the ball return surface, the chute adapted for receiving and retaining said basketball as it leaves the ball return surface; and (c) means for permitting the linear indexing of the vertical support member through the return surface and permitting the free movement of said basketball.

34. The apparatus of claim 33, wherein the means for permitting the linear indexing of the vertical support member through the ball return surface includes two substantially parallel return surface support members, the members being mounted on the front wall of the enclosure and lying substantially in the plane of the ball return surface and adapted to be connected to the ball return surface, the spacing between the return support members adapted to permit the passage of the vertical support member therebetween without permitting said basketball to be lodged therebetween or fall through.

35. The apparatus of claim 33, wherein the ball return surface includes a net.

36. The apparatus of claim 33 wherein the ball return surface includes an elastomeric material.

37. The apparatus of claim 33, wherein the means for suspending the ball return surface in close proximity to the front wall and two side walls includes suspending the ball return surface on the walls.

38. The apparatus of claim 25, wherein the means of creating a visual disturbance along the walls of the enclosure comprises:

(a) a pre-recorded video cassette having video information thereon;

(b) a video cassette recorder; and (c) a video projection unit mounted on the back wall of the enclosure, the video projection unit being connected to the video cassette recorder, the projection unit thereby projecting the prerecorded video information on the walls of the enclosure.

39. The apparatus of claim 25, wherein the means of creating an audial disturbance comprises:

(a) a prerecorded audio cassette;

(b) an audio cassette player; and (c) speakers mounted in the enclosure, the speakers being connected to the audio cassette player thereby reproducing the prerecorded sounds of the audio player.

* * * * *